United States Patent [19]

Katayama et al.

[11] 4,169,701

[45] Oct. 2, 1979

[54] FLUIDIZED-BED KILN WITH PREHEATING MEANS

[75] Inventors: Toshio Katayama; Kunihisa Fujiwara, both of Hiroshima; Yoshimine Jahami, Itsukaichi, all of Japan

[73] Assignees: Mitsubishi Jukogyo Kabushiki Kaisha; Yoshizawa Sekkai Kogyo Kabushiki Kaisha, both of Japan

[21] Appl. No.: 853,819

[22] Filed: Nov. 21, 1977

[30] Foreign Application Priority Data

Nov. 29, 1976 [JP] Japan ..... 51-142193

[51] Int. Cl.[2] ..... F27B 15/00

[52] U.S. Cl. ..... 432/58; 432/78; 432/106

[58] Field of Search ..... 432/15, 58, 106, 77, 432/78; 106/100; 34/62, 64, 66

[56] References Cited

U.S. PATENT DOCUMENTS

| | | | |
|---|---|---|---|
| 2,763,478 | 9/1956 | Parry | 432/15 |
| 3,804,581 | 4/1974 | Schmalfeld et al. | 432/15 |
| 3,891,382 | 6/1975 | Lawall et al. | 432/58 |
| 3,891,383 | 6/1975 | Kobayashi | 432/106 |
| 3,929,417 | 12/1975 | Rosa et al. | 432/106 |
| 3,998,929 | 12/1976 | Leyshon | 432/15 |
| 4,017,585 | 4/1977 | Angevine et al. | 432/15 |

*Primary Examiner*—Henry C. Yuen
*Attorney, Agent, or Firm*—McGlew and Tuttle

[57] ABSTRACT

A fluidized-bed kiln equipped with preheating means comprises suspension-type material preheating means having one or more cyclones, a fluidized-bed calciner for receiving the preheated material from the cyclone or the lowermost of the cyclones and forming a fluidized bed of the material within the calciner, and a collecting cyclone for collecting the hot gases carrying the calcined material, separating them into solids and gases, and conducting the calcined material into cooling means and the hot gases into the cyclone or the lowermost of the cyclones. The cooling means is, for example, a fluidized-bed cooler.

5 Claims, 3 Drawing Figures

FLUIDIZED-BED KILN WITH PREHEATING MEANS

This invention relates to improvements in a fluidized-bed kiln, and more specifically to such a kiln improved in economy, operation performance, and quality of the product.

Kilns in varied forms have been developed and commercially accepted. For example, the kiln for calcining limestone to produce quicklime is available in types as tabulated below.

| | Rotary kiln | Shaft kiln | Rotary hearth | Multiple fluidized-bed kiln |
|---|---|---|---|---|
| Calcining capacity (t/h) | 100–1000 | 200–400 | 100–500 | 50–300 |
| Limestone particle size (mm) | 6–50 | 25–60 | 3–40 | 1–5 |
| Type of fuel | Gas/oil/coal | Gas/oil | Gas/oil | Gas/oil |
| Heat consumption (Kcal/kg) | 1900–1300 | 900–1000 | 1400–1450 | 1200–1300 |
| Residual $CO_2$ in product (%) | 1.5–2.0 | 1.5–2.0 | 1.0–1.5 | 0.5–0.2 |
| Investment on equipment | 100 (basis) | 100–120 | 110–140 | 130–180 |

These types, however, have the following disadvantages: (1) The rotary kiln secondarily produces a large volume of dust, involves much fuel consumption, and is unsuitable for the calcination of fine limestone material. (2) The shaft kiln cannot burn coal and its calcining capacity is limited. This type is not suited for fine raw material, either. (3) The rotary hearth requires a comparatively large initial investment, and yet its calcining capacity is small. Furthermore, it cannot handle the limestone less than 3 mm in particle size. (4) In case of the multiple fluidized-bed type, the equipment cost is the highest. If a large capacity is to be had, the kiln must be of a correspondingly large diameter. This will make the fuel supply to the furnace center difficult, with the result that the center portion will not serve effectively as a fluidized bed. Thus, a large capacity equipment of this type is impossible to build. In addition, the kiln is unable to calcine the fine feed less than one millimeter in particle size.

Incidentally, it has recently been found in the iron-manufacturing industry that replacing two to three percent of limestone consumption for sintering the ore by fine quicklime brings much beneficial effects on the operation and that the finer the particle size the better the result. Therefore, the demand for such fine quicklime is steadily growing.

With these in view, we made extensive studies in search of a lime kiln which would meet all of five requirements, i.e., (a) ability to handle the undersieve fine limestone as the material; (b) large calcining capacity and hence low investment on equipment; (c) free choice of fuel among gas, oil, or coal; (d) low heat consumption; and (e) high product quality. As a result, the kiln of the present invention has now been developed which can calcine not only fine limestone but many other materials, such as coarse lime, rich phosphate rock, and alumina, as well.

Thus, the invention resides, in essence, in a fluidized-bed kiln equipped with preheating means, comprising suspension-type material preheating means having one or more cyclones, a fluidized-bed calciner for receiving the preheated material from the cyclone or the lowermost of the cyclones and forming a fluidized bed of the material within the calciner, and a collecting cyclone for collecting the hot gases carrying the calcined material, separating them into solids and gases, and conducting the calcined material into cooling means and the hot gases into the cyclone or the lowermost of the cyclones.

The kiln according to the invention will be more fully described hereunder with reference to the accompanying drawings, wherein.

Figure 1:
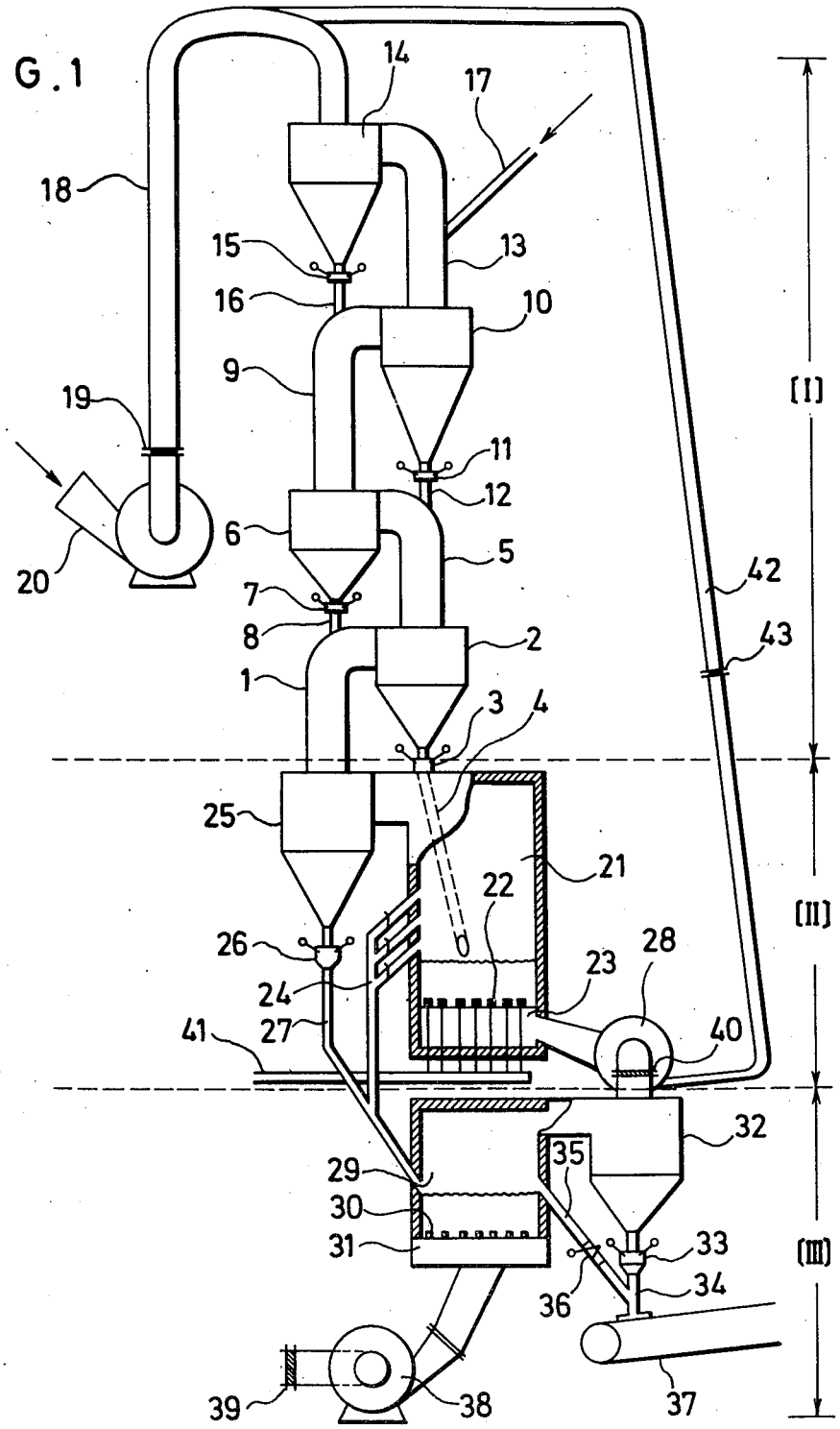
FIG. 1 is a schematic view of a kiln embodying the invention.

Referring specifically to FIG. 1, the kiln according to this invention consists of three zones; a suspension-type material preheating means zone (I), a fluidized-bed calcining zone (II), and a product cooling means zone (III). The three zones are constructed as follows.

The suspension-type material preheating zone (I) comprises four-stage cyclones 2, 6, 10, 14, inlet ducts 1, 5, 9, 13 for the respective cyclones, material chutes 4, 8, 12, 16 under the cyclones, gas check valves 3, 7, 11, 15 attached to the material chutes, a material feed inlet 17, an exhaust gas duct 18, an induced draft fan 20, and a damper 19 for the fan. The first-mentioned duct 1 is connected at the bottom to a collecting cyclone 25 to be described below.

The fluidized-bed calcining zone (II) comprises a calciner body 21 having a number of nozzles 22 equipped with a corresponding number of burners and an air chamber 23 at the bottom. As auxiliary equipment, it includes an overflow chute 24 for the product, a collecting cyclone 25 for separating the combustion gas and decarbonated gas from the product suspended in the gases, a product chute 27 under the collecting cyclone, and a gas check valve 26 installed above the product chute. It further includes a fluidizing fan 28 whose entrance communicates with the exit of a cooled-product collecting cyclone 32 to be described below, a damper 40, and a fuel line 41.

The product cooling zone (III) includes a fluidized-bed cooler body 29 having a number of air nozzles 30 and an air chamber 31 at the bottom. It includes as auxiliary equipment a product overflow chute 35, air check valve 36, cooled-product collecting cyclone 32, product chute 34 below the collecting cyclone, air check valve 33, cooling fan 38, and an inlet damper 39. Where necessary, a bypass duct 42 may be provided which extends from the outlet of the cooled-product collecting cyclone 32 and joins the exhaust gas duct 18, with an air-quantity controlling damper 43 installed midway.

The operation of the kiln according to the invention will now be described in connection with calcination of fine limestone material by way of example.

Limestone in the form of fine particles that has passed a 6-mm sieve and having a moisture content of not more than about 5% is weighed, and the metered quantity is fed at the material inlet 17 into the duct 13. Inside the duct 13 there is an upward flow of hot exhaust gases from the fluidized-bed calciner 21 caused by the induced draft fan 20. The fine feed is suspended in and preheated by the exhaust gases, collected by the cyclone 14, and is released into the duct 9 via the gas check valve 15 and the chute 16. In this duct 9, the fine material is subjected to a second-stage heat exchange with gases at a higher temperature in a countercurrent, upward flow. In the manner described the material goes through several stages (four stages in FIG. 1) of heat exchange until it attains a temperature between 750° and 820° C. The material thus preheated is charged through the material chute 4 into the fluidized-bed calciner 21.

In the calciner 21, the charge is fluidized under pressure by hot air supplied by the fluidizing fan 28 to the air chamber 23. The hot air comes from the product cooler 29 and on its way is freed from dust by the cooled-product collecting cyclone 32. On the other hand, a metered amount of fuel is introduced from the fuel line 41. It is injected, together with air, into the fluidized charge by the air nozzles 22, and is burned with the fluidizing air. This combustion heats the material to a temperature in the range from 820° to 1100° C. and causes its decarbonation reaction to give a calcined product.

Coarse particles of the material that cannot be suspended in the upward stream of exhaust gases fall through the duct 13 and exchange heat with the gases in the countercurrent flow as the material moves downward through the cyclone 10, check valve 11, chute 12, duct 5, cyclone 2, check valve 3, and chute 4, in the descending order. Finally the coarse particles enter the fluidized-bed calciner 21, where they are calcined to be a product in the same way as the fine particles already explained.

Of the product burned in the way described, the fines suspended in the combustion gas are collected by the cyclone and thence conducted to the product cooler 29 and the coarser particles are conducted to the product cooler 29 via the overflow chute 24. Coarser particles must be retained longer in the fluidized-bed calciner 21, the retention time being dependent upon the size of particles. For this reason the overflow chute 24 is designed to be shiftable in height (to three different levels, for example, in the arrangement of FIG. 1).

In the product cooler 29, the product at a temperature between 820° and 1100° C. is cooled, while being fluidized, through exchange of heat with a stream of cold air controlled in quantity by the louver damper 39 and blown in through the air chamber 31 and air nozzles 30 by the cooling fan 38.

The cooled fine product is carried by the air heated by the heat exchange into the cooled-product collecting cyclone 32, where it is separated from the air. The product moves downward through the check valve 33 and the chute 34 onto a product conveyor 37, by which it is carried out for storage.

The cooled coarse product is carried through the overflow chute 35 and the check valve 36 onto the product conveyor 37, and is also carried out for storage.

Meanwhile, the hot air dedusted by the cooled-product collecting cyclone 32 is utilized, in the manner already explained, as the fluidizing air for the fluidized-bed calciner 21. If the cooling with only the air for fuel burning is insufficient, excess air may be blown in by the cooling fan 38 so that a part of it can be bypassed through the bypass duct 42 that provides communication between the exhaust gas duct 18 of the preheating zone and the exit of the cooled-product collecting cyclone 32. In that case, the air quantity to be bypassed can be controlled by means of the damper 43.

In the operation described above, the kiln according to this invention calcines the varied materials as already mentioned.

Figure 2:
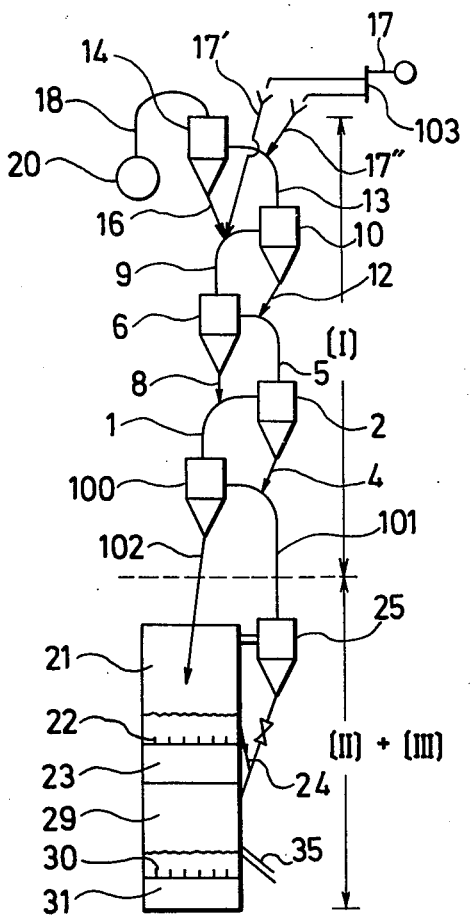
FIG. 2 is a view similar to FIG. 1 but showing the embodiment with some modifications.

It is to be noted that, in the kiln of the invention, the number of cyclones for the suspension-type preheating zone (I) is not necessarily even; an odd number of cyclones may be used instead, provided the material is fed in the manner as will be described below in conjunction with FIG. 2. Referring to FIG. 2, in which numerals like those in FIG. 1 designate like parts, a sieve 103 is attached to the material feed inlet 17 so that the feed can be separated into two streams of coarse and fine particles. The particles too large in size to be suspended in the exhaust gases are conducted through a bypass line 17' into the inlet duct 9 of the second cyclone 6. On the other hand, the fines may be supplied to the inlet duct 13 of the first, topmost cyclone 10 in the manner already explained with reference to FIG. 1. In this way, the coarse material passes downward through the cyclone 6, chute 8, duct 1, cyclone 100, and chute 102, that is, through the two cyclones 6 and 100, into the fluidized-bed calciner 21. The fine material, by contrast, is introduced through all (five, in this case) of the cyclones into the same calciner 21, as described in connection with FIG. 1.

Thus, the suspension-type preheating zone (I) using an odd number of cyclones requires some modifications in design because large particles fall substantially vertically. For this reason, the arrangement including an even number of cyclones as illustrated in FIG. 1 is preferred where coarse material that cannot be suspended in the upward stream of exhaust gases or a material with a high percentage of such large particles is to be handled.

In the kiln of the invention, the cooled-product collecting cyclone 32, fluidizing fan 28, and the associated parts shown in FIG. 1 may be omitted by combining the upper portion of the cooler 29 integrally with the air chamber 23 of the fluidized-bed calciner 21 as in FIG. 2.

In this case, fluidizing air is directly blown into the air chamber 23 and thence into the bed of material through the nozzles 22 to fluidize the same. Of the calcined material, fine particles are collected by the cyclone 25 and coarse particles are led into the overflow chute 24, and then the both meet in the cooler 29.

Inside the cooler 21, the calcined product is cooled by cooling air blown in through the air chamber 31, and then is discharged out of the kiln through the overflow chute 35.

Figure 3:
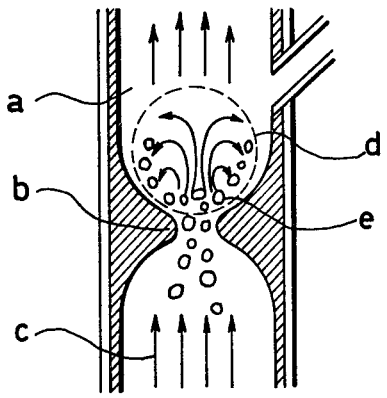
FIG. 3 is a fragmentary sectional view of a form of ducting for the kiln of the invention.

With the kiln of the invention it is further possible to modify the duct structure as shown in FIG. 3. The duct a is shown with a constriction b formed midway so that the upward flow c of exhaust gases can form a turbulent jet layer d in the space immediately above the constriction b. This structure extends the retention time of coarse particles e that flow countercurrent to the exhaust gas stream for heat exchange, making it possible to shorten the length of the duct a itself. This modified design of the duct a is applicable, for example, to the inlet ducts 1, 5, 9, 13 of the cyclones.

Exemplary operation of the kiln in accordance with the invention will be described below.

EXAMPLE

With the kiln shown in FIG. 1, limestone of the following properties was calcined, using bunker C oil as the fuel for the calciner.

PROPERTIES OF LIMESTONE AS FEED MATERIAL 5-mm undersieve
(particles finer than 125 μ accounting for 14.2% of the total)
Average particle size: 1.3 mm
Chemical analysis value: 55–56% CaO
Average moisture content: 3.2%

PROPERTIES OF CALCINED PRODUCT

Residual $CO_2$ content:
Not more than 0.5%
Activity of product:
Value after 10 minutes of titration with 4-normal HCl (25 g sample)
neutralized with over 190 cc
Heat consumption:
≦1150 Kcal/kg of product In further experiments, gas and coal were employed in place of oil as the fuel for the calciner. There was no objectionable effect.

In case of a limestone kiln with a daily production capacity of 1000 tons built in accordance with the invention, the investment on equipment was 70%, and the space requirement was only 30%, of those of an ordinary rotary kiln of the same capacity.

Moreover, because the combustion for calcination in the kiln of the invention takes place at a lower temperature than in other kilns, thermal production of nitrogen oxides was avoided and the NOx emissions from the kiln were negligible. To be more concrete, combustion tests with bunker C oil gave values of not more than 60 ppm (measured on the basis of 10% $O_2$).

What is claimed is:

1. A fluidized-bed kiln equipped with preheating means, comprising suspension-type material preheating means having one or more cyclones, a fluidized bed calciner for generating hot gases and for receiving the preheated material from said cyclone or the lowermost of said cyclones and forming a fluidized bed of said material within said calciner so that the hot gases carry the calcined material, and a collecting cyclone for collecting the hot gases carrying the calcined material, separating the same into solids and gases and having a collecting cyclone outlet, and conducting said calcined material into cooling means and said hot gases into said cyclone or the lowermost of said cyclones.

2. A fluidized-bed kiln according to claim 1, wherein said cooling means comprises a fluidized-bed cooler connected to said collecting cyclone, a cooled-product collecting cyclone connected to said cooler, and a fluidizing fan connected to the outlet of said collecting cyclone to supply hot air to said fluidized-bed calciner.

3. A fluidized-bed kiln according to claim 1, wherein said cooling means comprises a fluidized-bed cooler connected to said collecting cyclone and formed integrally with the air chamber of said fluidized-bed calciner.

4. A fluidized-bed calciner according to any of claim 1, wherein the inlet duct of said cyclone or cyclones has a constriction formed inside.

5. A fluidized bed kiln comprising a fluidized bed calcining zone including a calcining housing having a fluidized bed base, a plurality of nozzle burners firing into said housing adjacent said base and a fluidizing fan for maintaining the bed in a fluidized state; a preheating zone including a plurality of heating cyclones arranged in a series with each one feeding into the next adjacent cyclone, inlet means for directing lime stone particles into one of said cyclones, and induced fan means for directing gaseous products through said cyclones from said calcining housing; and a product-cooling zone including fluidized bed cooler housing connected to said plurality of cyclones and to said calcining housing for receiving the calcined material, a cooled product cyclone connected to said cooler housing, cooler fan means connected to said cooler housing for cooling the product and directing it into said cool product cyclone, and conveyor means connected to said cooled product cyclone to carry off the cooled product.

* * * * *